US007862095B2

(12) United States Patent
Rodriguez

(10) Patent No.: US 7,862,095 B2
(45) Date of Patent: Jan. 4, 2011

(54) SANDWICHES 'N MORE TODDLER UTENSIL

(76) Inventor: Deborah Suzanne Rodriguez, 3005 Countrybend La., Champaign, IL (US) 61822

( * ) Notice: Subject to any disclaimer, the term of this patent is extended or adjusted under 35 U.S.C. 154(b) by 408 days.

(21) Appl. No.: 11/979,422

(22) Filed: Nov. 2, 2007

(65) Prior Publication Data

US 2008/0116705 A1 May 22, 2008

Related U.S. Application Data

(60) Provisional application No. 60/857,256, filed on Nov. 8, 2006.

(51) Int. Cl.
*A47J 43/28* (2006.01)
*A47G 21/10* (2006.01)

(52) U.S. Cl. ..... 294/99.2; 294/16; 294/25

(58) Field of Classification Search ..... 294/5, 294/16, 25, 99.2, 902; 24/30.5 R, 505, 508, 24/511, 502

See application file for complete search history.

(56) References Cited

U.S. PATENT DOCUMENTS 1,030,729 A * 6/1912 Horton ..... 294/5
1,117,740 A * 11/1914 Witt ..... 294/25
2,010,074 A * 8/1935 Fuerst ..... 30/150
2,585,089 A * 2/1952 Caldwell et al. ..... 24/559
2,891,814 A * 6/1959 Idoine et al. ..... 294/99.2
2,999,713 A * 9/1961 Jones ..... 294/5
4,261,608 A * 4/1981 Bradshaw ..... 294/25
4,802,704 A * 2/1989 Burns ..... 294/99.2
4,923,234 A * 5/1990 Fairley ..... 294/99.2
5,054,226 A * 10/1991 Hart ..... 43/4
5,709,423 A * 1/1998 Romero ..... 294/25
5,934,721 A * 8/1999 Walde ..... 294/3
6,056,342 A * 5/2000 Chan ..... 294/99.2
6,494,517 B1 * 12/2002 Durant ..... 294/99.2

* cited by examiner

*Primary Examiner*—Dean J Kramer

(57) ABSTRACT

Disclosed are methods and apparatus for empowering a toddler or person with a disability to eat whole foods, such as sandwiches, pizza, waffles, burritos, etc. more efficiently than without the aid of the apparatus, which apparatus has two body units, each having surfaces capable of holding a food product between them, and a compression component operationally connected to the two body units that controls the amount of force exerted by the surfaces on the food product when the food product is between the surfaces, at least two handles on the device, which handles project from the body unit, and are adapted to be held by a pair of hands, and an area on each body unit, which permit compression of these areas to move apart the surfaces.

20 Claims, 4 Drawing Sheets

Front View

Front View

Top View

Bottom View

Side View

SANDWICHES 'N MORE TODDLER UTENSIL

This application claims the benefit of the filing date of U.S. Provisional Application Ser. No. 60/857,256 filed Nov. 8, 2006.

Most toddlers go through a stage when they do not like to eat certain foods (i.e., sandwiches, pizza, burritos) cut in pieces, yet are still not capable of efficiently eating the whole food with their small hands. The child often pulls the pieces of the food apart and/or the food is discarded onto the floor. This leads to insufficient eating during a time when proper eating is critical to the child's growth and development. As a result it is very challenging for the parent or caregiver to provide foods that the toddler will actually eat and are at the same time nutritious.

This invention, hereinafter also referred to as a utensil or device, assists toddlers in eating sandwiches, pizza, waffles, and the like. Toddlers transition from infants who eat primarily with their hands or who are fed by an adult, to more capable children who can effectively use a spoon and fork. Adults encourage toddlers to regularly use these utensils when eating their food. This can create confusion for a child since there is currently no device on the market for eating whole foods. A toddler cannot easily distinguish between foods that are acceptable to eat with their hands and others that require a utensil. This utensil therefore provides consistency for the beginner self feeder. It also empowers a toddler to comfortably eat whole foods by providing ergonomic handles, until which time they are old enough to comprehend how to use their hands to grasp certain foods.

The device contains parts that securely hold the food and has at least two, but more preferably four handles. Multiple handles on the device help the toddler achieve more control while eating. The device clamps or otherwise secures to the sides of the food so that the toddler may hold onto the attached handle(s) of the device and eat the food.

The device has tension adequate for holding the two sides of the food within the device. This tension can be provided by a spring-like mechanism that holds the two parts of the device together, or via a locking, ratcheting and/or other tension mechanism (hereinafter collectively also called tension component) that does the same. A device according to the invention can have one or more tension components. Preferred are devices with one tension component since it is easier for an adult to insert the food into the device with one hand while the other operates the single tension component. A single tension component also makes it easier to effectively clean the device.

The device may also contain a mechanism for adjusting the tension of the tension component. This can be advantageous in using the device with a variety of foods of varying characteristics. Softer foods can be held in place with less force than harder foods to prevent breakage of the food. A non-adjustable set tension device can also be advantageous since it is simpler for the end user to operate and it is cheaper for a manufacturer to produce.

The device additionally may contain a locking component (which may be detachable) that can prevent further movement of the device once a food item is secured in the device. This would prevent the toddler from opening and consequently removing the food from the device.

The handles of the device may be permanently attached as one unit with the device or removable from the device. If removable, the handles can have interchangeable shapes and/or designs that slide and/or lock onto the device and can be held by the toddler once the adult locks them into place. This interchangeable handle setup can make using the device more interesting for the toddler over time, and can make the device more marketable to parents and caregivers. The handles will be ergonomically designed for the end user, and may have ridges guiding fingers for proper gripping or may be smooth, etc. The shape of the handles may be cylindrical or any other desirable shape, object, or character as designed for the end user.

In a preferred embodiment, the surfaces of the device according to the invention are smooth and contain few irregularities so that they are easily cleaned. Areas where food items can remain after washing are preferably avoided when designing a device according to the invention. For example, it is preferred that the handles are flush with the frame of the device to avoid areas where food may remain after cleaning.

An embodiment of the design could be adjustable sides of the device (e.g. locking pivot points on each side of the device) that allow the angle of the sides to change, thus allowing for a wide range of foods of varying sizes to be held by the device. Another consideration is to manufacture the device, without pivoting sides, in several different sizes to accommodate various types of foods.

The device can be constructed of plastic, stainless steel, and/or other similar anti-rust material that will be easily washed with soap and water. Materials typically used for utensils are all possible options. For example, in a preferred embodiment the body of the device is constructed of injection molded FDA Approved Food Grade Polypropylene and the tension component is a torsion spring and pin combination constructed of stainless steel.

The exact design of the device is not critical as long as it achieves the objective of aiding the toddler in eating, and preferably it should be safe, ergonomic, user friendly, durable, and easy to clean.

The device and its components should be sufficiently large to prevent swallowing of the utensil and its components by the child. The dimensions of the device for example, can be 7" wide by 5" tall. It is important to design the utensil so it is large enough to adequately hold the food, but not be oversized as to overwhelm the parent/caregiver who is purchasing the utensil and distract the child who is using the utensil. Therefore, the preferred dimensions are 6" wide from handle to handle, and 3.3" tall from handle to top of the utensil. The preferred dimensions of the handle are 2.25" long and 0.5" wide, but all handle types designed for children could be used. The above provided dimensions can vary, each independently, e.g., by ±0.25", ±0.5", ±0.75", ±1.0", ±1.25", etc.

The device according to the invention can also help in teaching a child how to eat a food item properly, eventually without the aid of the device. With continued use of the device a toddler learns that he/she is capable of eating a sandwich, for example, without pulling the bread apart or breaking the food into smaller pieces. As a normal progression with time, the toddler will discontinue use of the device. He/she is then more likely to eat the food item without damaging said food item once the use of the device according to the invention has ceased. Thus, a device according to the invention can be used as a teaching/learning tool for a toddler on how to properly hold and eat a food item. The use of the device provides a guide to a toddler on how to hold and eat a food item properly. Thus, the methods of this invention include using a device according to the invention to this end.

In various preferred embodiments, the invention includes:

A device for holding a food product that is to be eaten by a toddler or an individual with disabilities comprising:

a) a body unit 1 having a surface 1' and a body unit 2 having a surface 2', wherein surfaces 1' and 2' are capable of holding a food product between said surfaces 1' and 2', b) a tension component operationally connected to body unit 1 and 2 that controls the amount of force exerted by surfaces 1' and 2' on the food when said food is between said surfaces 1' and 2', c) at least two handles on the device, and d) an area on body unit 1 and an area on body unit 2, which permit operation of the tension component.

In further preferred embodiments, the device further comprises of a locking mechanism that allows the surfaces to be locked into a position;

has 2 to 4 handles;

the surfaces 1' and 2' are smooth;

the body unit 1 and 2 contain ridges, dimples, or elevated regions that project toward the food when between said surfaces 1' and 2' and allow for enhanced surface contact with the food;

the body unit 1 and 2 is each made of a single piece of material that has two elongated parts, where the angle between said two elongated parts is 30 to 150 degrees, preferably 90 degrees;

the body unit 1 and 2 is each made of two or three pieces of material, wherein each body unit has two elongated parts, where one or both of the elongated parts are made of a separate piece of material than the rest of the body unit, and where said one or both elongated parts are connected to the rest of the body unit pivotally such that the angle between said two elongated parts can be adjusted;

the at least two handles on the device are located on the two elongated parts of the body unit 1 and 2 and are angled about 90 degrees from said surfaces 1' and 2';

the at least two handles are permanently attached to the device;

the at least two handles are detachable from the device;

the tension component is between the two body units;

the tension component contains a spring made of non-rusting metal;

the tension component contains a "U" shaped rectangular piece of non-rusting metal or plastic;

the amount of force exerted by surfaces 1' and 2' controlled by the tension component is adjustable;

the amount of force exerted by surfaces 1 and 2 controlled by the tension component is fixed;

body units 1 and 2 comprise of durable, non-rusting metal and/or plastic material suitable for use with food.

The invention also includes a method for aiding a toddler or an individual with disabilities to hold a food product that is to be eaten, comprising of providing the toddler or the individual with disabilities a device for holding the food. The said device comprises:

a) a body unit 1 having a surface 1' and a body unit 2 having a surface 2', wherein surfaces 1' and 2' are capable of holding a food product between said surfaces 1' and 2', b) a tension component operationally connected to body unit 1 and 2 that controls the amount of force exerted by surfaces 1' and 2' on the food product when said food product is between said surfaces 1' and 2', c) at least two handles on the device, and d) an area on body unit 1 and an area on body unit 2, which permit operation of the tension component.

In a further embodiment, the method includes providing the device to a toddler or an individual with disabilities to hold a food product that is to be eaten when a food product is held between surfaces 1' and 2'.

The invention also includes a method for producing a device described above, comprising molding one or more parts of said device from a polymeric material.

DRAWINGS

Brief Description of Drawings

In FIG. 1, a device according to the invention contains two parts, a top part 1, and a bottom part 2. In this embodiment of the invention, each of the top and bottom parts has two handles 3, 4, 5, and 6 and each of the top and bottom parts has two extended regions 1*a*, 1*b*, 2*a*, and 2*b*, that shall be in contact with the food item to be held by the device. That is, the food item will be held in place between region 1*a* of the top part of the device and region 2*a* of the bottom part of the device and region 1*b* of the top part of the device and region 2*b* of the bottom part of the device. The top and bottom part are connected via a tension component 7 that exerts an adequate force between the regions 1*a* and 2*a* and the regions 1*b* and 2*b* to hold a food item in place without crushing the same. Additionally, the device in this preferred embodiment contains dimples 8 in each of regions 1*a*, 2*a*, 1*b* and 2*b* that aids in holding the food item securely. These dimples 8 are preferably convex toward the region of the device where the food item will be held defined by regions 1*a*, 2*a*, 1*b* and 2*b* of the device.

These dimples in other embodiments can be replaced by ridges in a variety of directions, or by surface irregularities of any shape, or can be absent. In a preferred design, the surface that touches the food is flat so that the pressure is equally distributed on the surface area of the food, thus reducing the likelihood of food breakage or damage. The region of the device where the food item will be held defined by regions 1*a*, 1*b*, 2*a* and 2*b* of the device can further contain a lip 9 which can provide additional support for holding the food item securely in place and increases durability to the units.

The regions 1*a* (side facing the region where the food is to be held in place, hereinafter referred to as food side) and 2*a* (food side) and similarly the regions 1*b* (food side) and 2*b* (food side), can be parallel to each other or can be angled in various ways to allow the device to hold food items of varying sizes securely in position.

Figure 1:
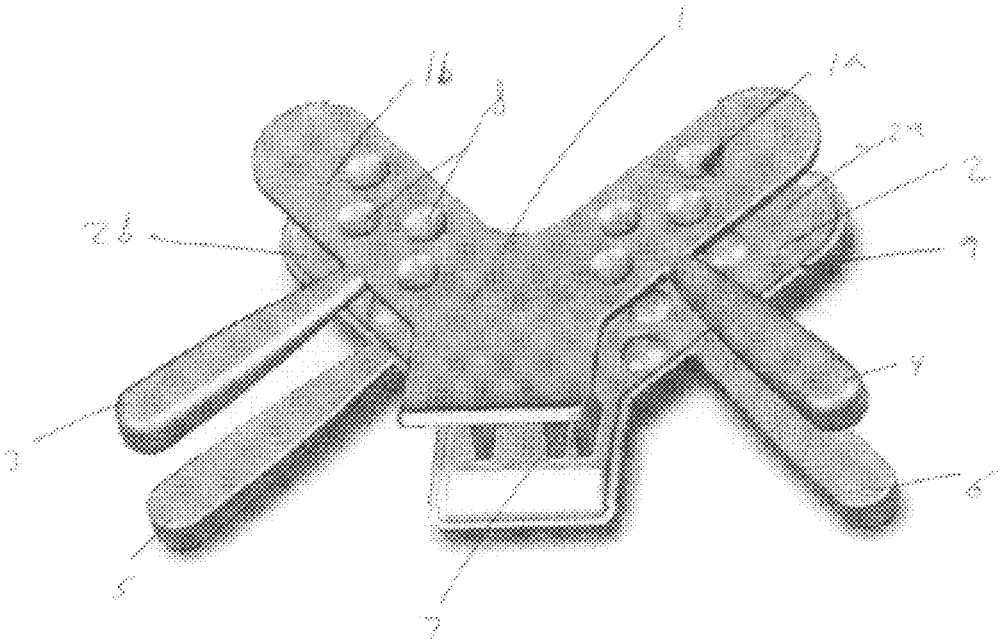
FIG. 1: Front view of a device according to the invention.
Figure 2:
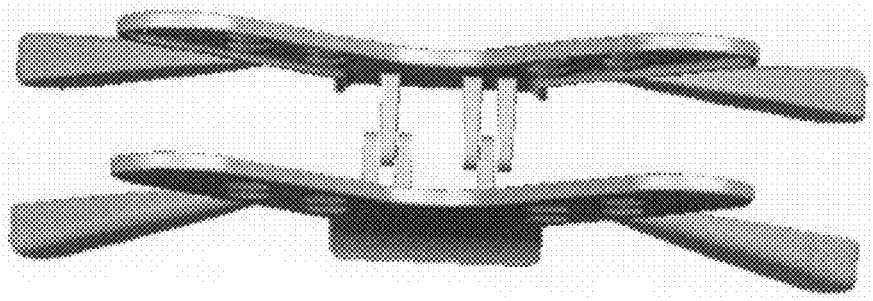
FIG. 2: Top view of a device according to the invention.
Figure 3:
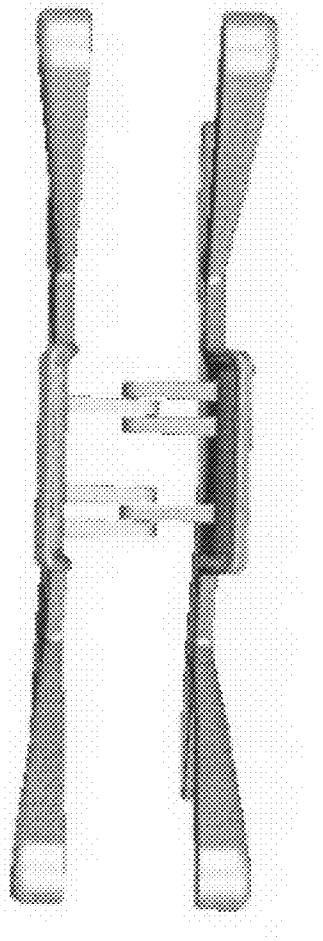
FIG. 3: Bottom view of a device according to the invention.
Figure 4:
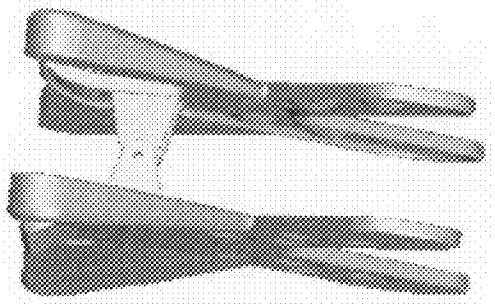
FIG. 4: Side view of a device according to the invention.

FIG. 2 is a top view, FIG. 3 is a bottom view, and FIG. 4 is the side view of the same device of FIG. 1. The tension component section 7 is more easily seen in these figures.

With respect to the above description, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described herein, and accordingly, all suitable modifications and equivalents may be resorted to, falling within the scope of the invention.

EXAMPLES OF REDUCTION TO PRACTICE

Example 1

A device according to the invention that has two independent separate clamping components is attached to each side of a peanut butter and jelly sandwich, then placed on a plate, and placed in front of a 29 month old male (this toddler is used for all the examples herein). The toddler immediately picks up the sandwich by the device that is attached to the sandwich and eats the entire sandwich using the device. The toddler appears extraordinarily happy as he eats the entire sandwich. It seems empowered by the tools he is provided to eat his food.

Example 2

A device according to the invention made of two independent separate clamping components that are different in shape and size is tested on the same toddler to help him eat a slice of pizza. The toddler is able to eat the entire piece of pizza and he does not prefer one type of handle size or shape to the other in this test.

Example 3

A device according to the invention having two clamping components that are connected to each other to form a single unit is used to assist the toddler to eat various foods. It appears that the toddler finds it easier to use a device that contains the clamping components in a single unit. Additionally, it appears that a single unit device achieves the additional benefit of preventing the toddler from pulling apart or twisting the food and making it separate or break. It is desirable for the food to maintain its original form in the device.

Example 4

A device made of two separate clamping components according to the invention is given to the same toddler with a grilled cheese sandwich, which is quickly eaten by the toddler.

Example 5

Two halves of a pizza pocket, one with a single clamping component according to the invention attached to it and the other without a device according to the invention, are set in front of the same toddler. He immediately picks up and starts eating the half with the single clamping component, and is successful in eating the pizza pocket.

Example 6

A device with a single clamping component according to the invention is tested with a bean burrito. The toddler eats the entire burrito quickly and easily using the device.

Example 7

A device with a single clamping component according to the invention is tested with a waffle. The toddler is first asked whether he wants to eat the waffle with or without the device. He says with the device and proceeds to eat the entire waffle with the attached device.

Example 8

A device with a single clamping component according to the invention is tested with a peanut butter and jelly sandwich. The toddler eats about ⅔ of the sandwich with the device, and then eats the remainder with his hands after the sandwich is removed from the device.

The entire disclosures of all applications, patents and publications, cited herein and of Provisional Application Ser. No. 60/857,256, filed Nov. 8, 2006, is incorporated by reference herein.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A device for holding a food product that is to be eaten by a toddler or an individual with a disability, comprising:

a) a body unit (1) having a surface (1') and a body unit (2) having a surface (2'), wherein surfaces (1') and (2') are capable of holding a food product between said surfaces (1') and (2'), b) a compression component operationally connected to body unit (1) and (2) that controls the amount of force exerted by surfaces (1') and (2') on the food product when said food product is between said surfaces (1') and (2'), c) at least two handles on the device, which handles project from the body unit (1) and/or body unit (2), and are adapted to be held by a pair of hands, and d) an area on body unit (1) and an area on body unit (2), which permit compression of said areas whereby the surfaces (1') and (2') move apart, wherein each of body units (1) and (2) are made of a single piece of material, wherein each has two elongated parts, where the angle between said two elongated parts of each body unit is fixed from 30 to 150 degrees.

2. A device according to claim 1 that has 2 handles.

3. A device according to claim 1, wherein body unit surfaces (1') and (2') are smooth.

4. A device according to claim 1, wherein body unit surfaces (1') and (2') contain ridges, dimples, or elevated regions that project toward the food when between said surfaces (1') and (2') and allow for enhanced surface contact with the food.

5. A device according to claim 1, wherein each of body units (1) and (2) are made of a single piece of material, wherein each has two elongated parts, where the angle between said two elongated parts of each body unit is fixed at 150 degrees.

6. A device according to claim 1, wherein the angle between said two elongated parts is 90 degrees.

7. A device according to claim 1, wherein the at least two handles on the device are located on the two elongated parts of the body unit (1) and (2) and are angled 90 degrees from said surfaces (1') and (2').

8. A device according to claim 1, wherein the at least two handles are permanently attached to the device.

9. A device according to claim 1, wherein the compression component is a spring between the two body units.

10. A device according to claim 1, wherein the compression component contains a spring made of non-rusting metal.

11. A device according to claim 1, wherein the amount of force exerted by surfaces (1') and (2') controlled by the compression component is fixed.

12. A device according to claim 1 comprising durable, non-rusting metal and/or plastic material suitable for contact with food.

13. A method for aiding a toddler or an individual with disabilities to hold a food product that is to be eaten comprising of providing the toddler or the individual with disabilities a device for holding the food product that is to be eaten, wherein the device is according to claim 1.

14. A method according to claim 13, wherein a food product is held between surfaces (1') and (2').

15. A method of producing a device according to claim 1, comprising molding one or more parts of said device from a polymeric material.

16. A device for holding a food product that is to be eaten by a toddler or an individual with a disability, comprising:

a) a body unit (1) having a surface (1') and a body unit (2) having a surface (2'), wherein surfaces (1') and (2') are capable of holding a food product between said surfaces (1') and (2'), b) a compression component operationally connected to body unit (1) and (2) that controls the amount of force exerted by surfaces (1') and (2') on the food product when said food product is between said surfaces (1') and (2'), c) 4 handles on the device, which handles project from the body unit (1) and/or body unit (2), and are adapted to be held by a pair of hands, and d) an area on body unit (1) and an area on body unit (2), which permit compression of said areas whereby the surfaces (1') and (2') move apart.

17. A device according to claim 16, wherein each of body units (1) and (2) are made of a single piece of material, wherein each has two elongated parts, where the angle between said two elongated parts of each body unit is fixed from 30 to 150 degrees.

18. A device according to claim 17, wherein the angle between said two elongated parts is 90 degrees.

19. A device according to claim 17, wherein the four handles on the device are located on the two elongated parts of the body unit (1) and (2) and are angled 90 degrees from said surfaces (1') and (2').

20. A device according to claim 16, wherein body unit surfaces (1') and (2') contain ridges, dimples, or elevated regions that project toward the food when between said surfaces (1') and (2') and allow for enhanced surface contact with the food.

* * * * *